US007175717B2

(12) United States Patent
Song et al.

(10) Patent No.: US 7,175,717 B2
(45) Date of Patent: Feb. 13, 2007

(54) METHOD FOR MAKING NANO-SCALE GRAIN METAL POWDERS HAVING EXCELLENT HIGH-FREQUENCY CHARACTERISTIC AND METHOD FOR MAKING HIGH-FREQUENCY SOFT MAGNETIC CORE USING THE SAME

(75) Inventors: Yong Sul Song, Seoul (KR); Hie Jin Kim, Seoul (KR)

(73) Assignee: Amosense Co., Ltd., Kyungko-do (KR)

( * ) Notice: Subject to any disclaimer, the term of this patent is extended or adjusted under 35 U.S.C. 154(b) by 394 days.

(21) Appl. No.: 10/683,396

(22) Filed: Oct. 14, 2003

(65) Prior Publication Data

US 2005/0034787 A1 Feb. 17, 2005

(30) Foreign Application Priority Data

Aug. 14, 2003 (KR) ..... 10-2003-0056609

(51) Int. Cl.
*H01F 1/153* (2006.01)
*H01F 1/22* (2006.01)

(52) U.S. Cl. ..... 148/104; 148/105

(58) Field of Classification Search ..... None
See application file for complete search history.

(56) References Cited

U.S. PATENT DOCUMENTS

| | | | | |
|---|---|---|---|---|
| 4,385,944 | A * | 5/1983 | Hasegawa | 148/104 |
| 4,985,089 | A * | 1/1991 | Yoshizawa et al. | 148/303 |
| 5,278,377 | A * | 1/1994 | Tsai | 219/759 |
| 5,509,975 | A * | 4/1996 | Kojima et al. | 148/104 |
| 5,741,373 | A * | 4/1998 | Suzuki et al. | 148/306 |
| 6,594,157 | B2 * | 7/2003 | Yoshida et al. | 363/14 |

* cited by examiner

*Primary Examiner*—John P. Sheehan
(74) *Attorney, Agent, or Firm*—Rosenberg, Klein & Lee

(57) ABSTRACT

A method for making a nano-scale amorphous soft magnetic powders obtained by thermally processing and crystallizing amorphous ribbons produced using a rapid solidification process (RSP) and crushing the same. The amorphous soft magnetic core having an excellent high-frequency characteristic is obtained by performing a preliminary thermal treatment of Fe-based amorphous metal ribbons produced by using RSP to then be converted into nano-scale grain metal ribbons, crushing the metal ribbons to thereby obtain nano-scale grain metal powders, classifying the nano-scale grain metal powders to then be mixed into a distribution of powder particles having an optimal uniform composition, mixing the mixed powder with a binder, and then forming a core, and annealing the formed core to then coat the core with an insulating resin.

7 Claims, 5 Drawing Sheets

METHOD FOR MAKING NANO-SCALE GRAIN METAL POWDERS HAVING EXCELLENT HIGH-FREQUENCY CHARACTERISTIC AND METHOD FOR MAKING HIGH-FREQUENCY SOFT MAGNETIC CORE USING THE SAME

BACKGROUND OF THE INVENTION

1. Field of the Invention

The present invention relates to a method for making a nano-scale grain metal powders and a method of making a high-frequency soft magnetic core using the same, and more particularly, to a method for making magnetic powders obtained by thermal treatment crystallizing and then crushing amorphous ribbons produced using a rapid solidification process (RSP), and a method for making a high-frequency soft magnetic core by using the same.

2. Description of the Related Art

In general, a Fe-based amorphous soft magnetic body which is used as a conventional high-frequency soft magnetic body has a high saturation magnetic flux density (Bs), but has a low magnetic permeability, a large magnetic deformation, and an inferior high-frequency characteristic. A Co-based amorphous soft magnetic body has a low saturation magnetic flux density and a drawback of an expensive raw material. In case of an amorphous soft magnetic alloy, it is difficult to shape it in the form of a strip, and is limited to form a product of a toroidal shape. Since a ferrite soft magnetic body has a low high-frequency loss and a small saturation magnetic flux density , it is difficult to accomplish a compact product. Both of the amorphous and ferrite soft magnetic body has bad reliability in thermal stability due to a low crystallization temperature.

An amorphous ribbon fabricated by a rapid solidification process (RSP) is wound to then be used as a soft magnetic core. In this case, the soft magnetic core has a remarkably low direct-current overlapping characteristic and a remarkably low high-frequency characteristic, as well as an inferior core loss. This is because a powder core product has an effect of uniformly distributing an air gap by forming an insulating layer between powder particles, but has no air gaps in the case of an amorphous ribbon wound core. Thus, a core which is formed by using an amorphous ribbon in order to improve a direct-current overlapping characteristic, has a thin gap. In this case, an efficiency is lowered and an electromagnetic wave can be influenced to other electronic products and the human body, due to a leakage flux produced from the gap.

Soft magnetic cores which are used in choke coils for suppressing or smoothing electronic noise are manufactured in a manner that ceramic insulation materials are coated on magnetic metal powder such as pure iron, Fe—Si—Al alloy (referred to as "Sendust" hereinbelow), Ni—Fe—Mo Permally (referred to as "MPP (Moly Permally Powder)" hereinbelow), and Ni—Fe Permally (referred to as "high flux" hereinbelow), and then forming lubricants are added on the coated metal powder, to then be formed by pressure and thermally treated.

First, a pure iron powder core has an advantage that a price of the core is inexpensive. However, a core loss is relatively very large. Accordingly, when the core is overheated during operation and high direct-current (DC) current is overlapped, a magnetic permeability is greatly lowered.

Meanwhile, an MPP core has an excellent frequency characteristic at a frequency ranging from 100 kHz to 1 MHz, and has the lowest core loss among all kinds of the metal powder. Also, the MPP core has an advantage that a magnetic permeability is a little reduced even with an high direct-current (DC) overlap. However, since the MPP core is very expensive, it is difficult to employ it in view of production cost.

A high flux core has an excellent frequency characteristic at a frequency ranging from 100 kHz to 1 MHz, and has the low core loss. Also, the high flux core has an advantage that a magnetic permeability is reduced in the least even with an high direct-current (DC) overlap, among all metal powder cores.

Also, a "Sendust" core has a very low core loss value in comparison with a pure iron core. The "Sendust" core has a frequency characteristic equivalent to those of the MPP and high flux cores, and is cheaper approximately half than the MPP and high flux cores. However, a direct-current (DC) overlapping characteristic at a flow of large current is relatively lower than those of the MPP and high flux cores. As a result, the "Sendust" core is limited in use at adverse circumstances.

A ferrite soft magnetic material has an advantage of a good magnetic permeability or a small core loss at a frequency of 500 kHz or higher, but has a small saturation magnetic flux density. As a result, the ferrite soft magnetic material is limited in making a compact and light product.

Thus, a variety of metal powder is employed in making a smoothing choke coil in a SMPS (Switching Mode Power Supply) in various forms for each use, considering a price, a core loss, a direct-current overlapping characteristic, and a core size. However, all kinds of the conventional metal powder cores can be used only at a frequency of 1 MHz or lower, but is limited in using it at a frequency of 1 MHz or higher.

Here, a direct-current overlapping characteristic is a magnetic core characteristic with respect to a waveform formed by feeble alternating-current, generated during converting an alternating-current input of a power supply into a direct-current, on which direct-current is overlapped. In the case that direct-current is overlapped over alternating-current, a core magnetic permeability is lowered in proportion with the direct-current. Here, the direct-current overlapping characteristic is estimated in a ratio (% μ-percent permeability) represented as a direct-current overlapping permeability with respect to a permeability at the state where direct-current is not overlapped, Meanwhile, in the conventional art, an insulation layer is formed between powder particles during making a soft magnetic core, to thereby uniformly distribute an air gap. Accordingly, an Eddy current loss sharply increasing at high-frequency is minimized, and the air gap is maintained in whole, to thereby accomplish an excellent direct-current overlapping characteristic at large current. However, the conventional are has a problem of lowering a magnetic permeability at a frequency band of 1 MHz or higher.

SUMMARY OF THE INVENTION

The inventors have recognized the above-described defects of the conventional art, and completed the present invention, considering the following points:

A material obtained by thermal treatment crystallizing Fe-based amorphous metal on a nano-scale basis maintains an excellent magnetic feature by a nano-scale grain at high-frequency;

The material obtained by thermal treatment crystallizing Fe-based amorphous metal on a nano-scale basis has four times a saturation magnetic flux density in comparison with ferrite, to thus make a product compact by a quarter, and has a saturation magnetic flux density higher than Co-based amorphous alloy, and a magnetic permeability higher than the Fe-based amorphous metal;

Since the material obtained by thermal treatment crystallizing Fe-based amorphous metal on a nano-scale basis is also Fe-based and a high economic crystalline alloy to thereby provide an excellent thermal stability, and minimize an Eddy-current loss at high-frequency, reduce a processing cost and form a product of a complicated shape, in the case that the material is crushed into powder.

To solve the above problems, it is an object of the present invention to provide a method for making nano-scale grain metal powders for power-factor correction and a method for making a high-frequency soft magnetic core using the same in which an insulation material is added in and coated on a nano-scale grain magnetic alloy powders having a high saturation magnetic flux density, to thereby obtain the nano-scale grain metal powders having a minimized Eddy-current loss, and an excellent magnetic permeability at a high-frequency of 1 MHz or higher.

It is another object of the present invention to provide a method for making nano-scale grain metal powders for power-factor correction and a method for making a high-frequency soft magnetic core using the same in which the nano-scale grain has a high saturation magnetic flux density, a high magnetic permeability, a low coercive force, and an excellent thermal stability, to thereby make a product of a core compact and light.

It is still another object of the present invention to provide a method for making nano-scale grain metal powders for power-factor correction and a method for making a high-frequency soft magnetic core using the same in which amorphous ribbons produced using a rapid solidification process (RSP) are crushed into metal powder having a high composition uniformity and a low oxidation level to thereby accomplish a high quality and a high reliability of a product of a core.

To accomplish the above object of the present invention, there is provided a method for making an amorphous soft magnetic core having an excellent high-frequency characteristic as well as an inexpensive price, by using a well-known amorphous metal ribbon produced using a rapid solidification process (RSP), in which the well-known Fe-based amorphous alloy comprising Fe as a basic composition, at least one metalloid element selected from the group consisting of P, C, B, Si, Al and Ge, and at least one selected from the group consisting of Nb, Cu, Hf, Zr and Ti which are transition metal. The most widely used alloy is a FeSiBNbCu-based alloy.

According to one aspect of the present invention, there is provided an amorphous soft magnetic core making method having an excellent high-frequency characteristic comprising the steps of: performing a thermal treatment of Fe-based amorphous metal ribbons produced by using a rapid solidification process (RSP) to then be converted into nano-scale grain metal ribbons; crushing the nano-scale grain metal ribbons to thereby obtain nano-scale grain metal powders; classifying the nano-scale grain metal powder to then be mixed into a distribution of powder particles having an optimal uniform composition; mixing the mixed nano-scale grain metal powders with a binder, and then forming a core; and annealing the formed core to then coat the core with an insulating resin.

BRIEF DESCRIPTION OF THE DRAWINGS

The above and other objects and advantages of the present invention will become more apparent by describing the preferred embodiment thereof in more detail with reference to the accompanying drawings in which.

DETAILED DESCRIPTION OF THE INVENTION

A method for making an amorphous soft magnetic core according to a preferred embodiment of the present invention will be described below with reference to the accompanying drawings FIGS. 1 through 5.

A Fe-based amorphous alloy which is used to obtain nano-scale grain metal powder is made of an amorphous alloy comprising Fe as a basic composition, at least one element selected from the group consisting of P, C, B, Si, Al and Ge, and at least one selected from the group consisting of Nb, Cu, Hf, Zr and Ti. A FeSiBNbCu-based alloy or Fe—X—B-based alloy where X=at least one selected from the group consisting of Nb, Cu, Hf, Zr and Ti which are transition metal, is generally widely used.

Figure 1:
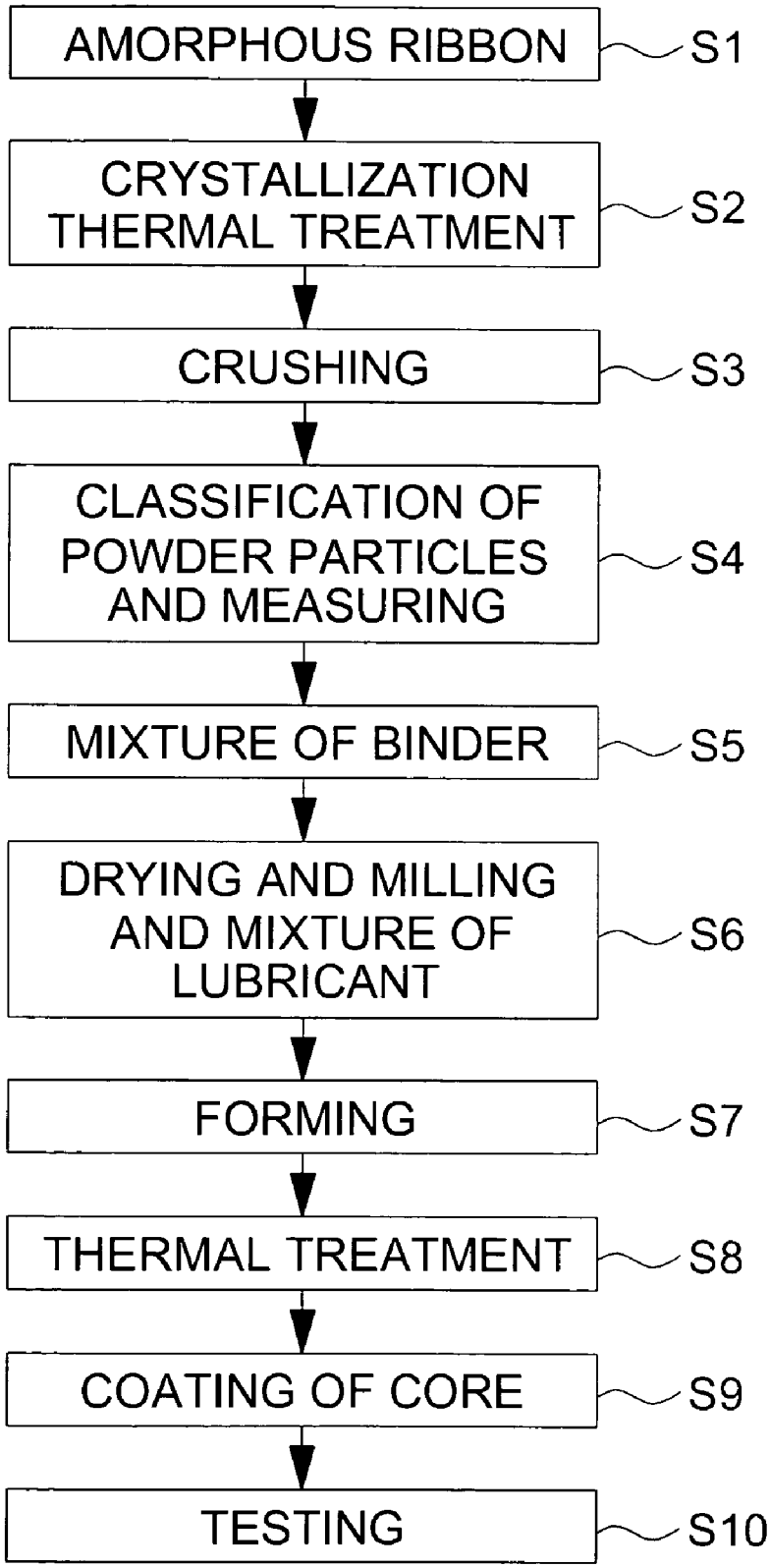
FIG. 1 is a flowchart view illustrating a method of making high-frequency soft magnetic core according to the present invention.
Figure 2:
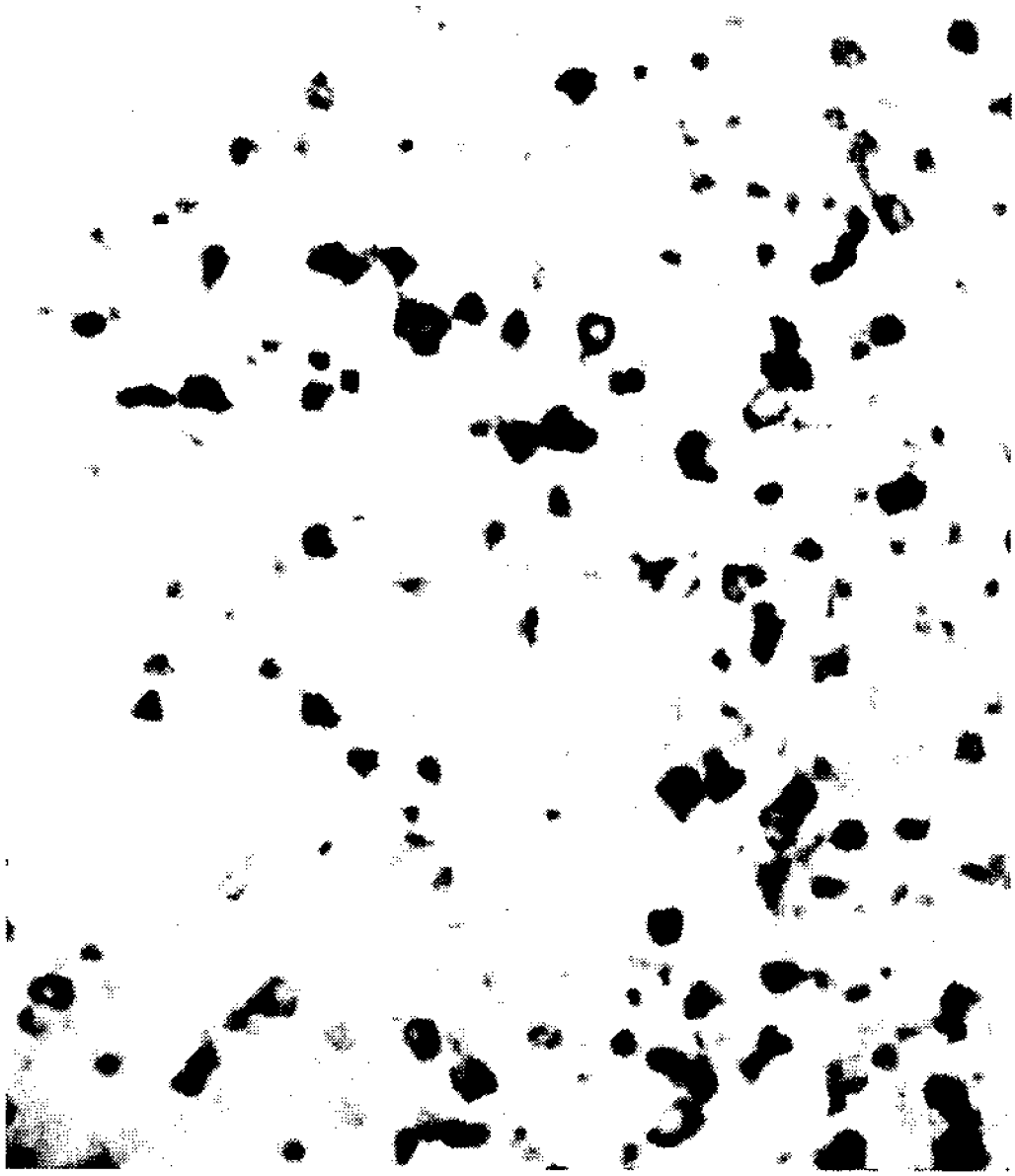
FIG. 2 shows a picture of a nano-scale grain ribbon by a transmissive electron microscope after thermal treatment.

Referring to FIG. 1 illustrating a method of making high-frequency soft magnetic core according to the present invention, the alloy is produced in the form of a ribbon by a rapid solidification process (RSP) (S1). The amorphous ribbon is then thermally treated and crystallized on a nano-scale basis for 0.2 to 1.5 hours at a temperature of 400 to 600° C. under the nitrogen in order to obtain a nano-scale grain ribbon (S2). FIG. 2 shows a picture of size of a grain observed by a transmissive electron microscope after nano-scale crystallization thermal treatment. As shown in FIG. 2, the most proper feature is obtained when the grain size is 10 to 20 nm. When the grain size exceeds a range between 10 to 20 nm, a magnetic permeability is reduced.

The reason of setting the temperature into the range from 400° C. to 600° C. in performing the nano-scale crystallization thermal treatment is because a nano-scale crystallization does not proceed at a temperature of 400° C. or lower, and growth of a crystallization grain may occur after having produced a nano-scale crystallization core at a temperature of 600° C. or higher.

Also, a time taken for nano-scale crystallization thermal treatment becomes long when a thermal treatment temperature is low, and short when a thermal treatment temperature is high. Thus, when a thermal treatment temperature is 400° C. which the lower-limit value, the nano-scale crystallization thermal treatment time is preferably 1.5 hours, and when a thermal treatment temperature is 600° C. which the upper-limit value, the nano-scale crystallization thermal treatment time is preferably 0.2 hours.

After having obtained the nano-scale grain metal ribbon, nano-scale grain metal powder can be obtained by crushing the nano-scale grain metal ribbon in a crusher (step S3). If a crushing condition during crushing, that is, a crushing speed and a crushing time are properly set, various types of powder having a variety of powder particles, a variety of shapes, and an irregular atomic arrangement state can be produced.

Since the metal powder obtained by using the physical crushing process has a composition uniformity and a low oxidation level in comparison with metal powder obtained by a general fluid spraying process, a product made by using the metal powder obtained in the present invention has an excellent uniformity. That is, the method of obtaining metal powders according to a crushing process of the present invention solves a problem of causing products to be deteriorated during mass-production due to lowering of the uniformity of the powder obtained by the conventional fluid spraying process.

Thereafter, the crushed nano-scale grain metal powder obtained through the crushing process has undergone a powder classification process, and thus is classified into powder having passed through a sieve of −100~+140 meshes and one having passed through a sieve of −140~+200 meshes, and then mixed into a distribution of powder particles having powder having passed through a sieve of −100~+140 meshes of 15~65%, and one having passed through a sieve of −140~+200 meshes of 35~85% (S4).

The distribution of powder particles is a composition ratio of powder particles for obtaining the most optimal physical characteristic and compositional uniformity. In the case of the preferable composition, the nano-scale grain metal powder shows the highest density of about 80~82%.

The reason why a distribution of particles of metal powder is set to include powder having passed through a sieve of −100~+140 meshes of 15~65%, and one having passed through a sieve of −140~+200 meshes of 35~85%, is because a magnetic permeability of 125 or high cannot be obtained if powder having passed through a sieve of −100~+140 meshes is used by 15% or less, and a targeted featured core cannot be obtained due to a crack caused during forming if powder having passed through a sieve of −100~+140 meshes is used by 65% or more.

Then, in order to manufacture the nano-scale grain metal powder fabricated as described above into a soft magnetic core for use in an inductor, ceramic such as MgO, $V_2O_5$ or glass having a low melting point of 1.5 wt %~5 wt % is mixed with the metal powder playing a role of a binder as well as an insulator (S5), to then perform drying. In the case that a content of the binder is 1.5 wt % or less, an amount of an insulation material is not sufficient and thus a high-frequency magnetic permeability of 10 MHz and 1V is lowered. On the contrary, in the case that a content of the binder is 5 wt % or more, an amount of an insulation material is excessive and thus a density of the nano-scale grain metal powder is reduced to accordingly lower a high-frequency characteristic magnetic permeability.

The drying process uses a solvent when the MgO, $V_2O_5$ or glass having a low melting point is mixed, in order to dry the MgO, $V_2O_5$ or glass having a low melting point. After having dried, a lump of powder works on a milling to then be re-crushed and thus coat the ceramic on the metal powder (S6).

A lubricant selected from the group consisting of Zn, ZnS, and stearate is added in the coated powder, and then mixed (S6). Then, a toroidal core is formed with a forming pressure of about 14~18 ton/cm$^2$, by using a press machine (S7). The lubricant is used in order to reduce a frictional force between the powder particles or between a formed body and a mold. It is preferable that a generally used Zn-stearate is mixed by 2 wt % or less.

Then, the toroidal core formed as described above is thermally treated, that is, annealed for 0.2 to 3.8 hours under the atmosphere at a temperature of 300~500° C., to thereby remove remaining tension and deformation (S8). In the case that the annealing process is performed at a temperature condition of 300° C. or lower or 500° C. or higher, a desired high-frequency magnetic permeability is not obtained irrespective of a thermal treatment time.

Thereafter, in order to protect a characteristic of a core from the moisture and atmosphere, polyester or epoxy resin is coated on the surface of the core, to thereby manufacture a nano-scale grain soft magnetic core (S9). Here, it is preferable that the thickness of the epoxy resin coating layer is generally 50~200 μm or so.

Hereinbelow, the present invention will be described in more detail through embodiments.

Embodiment 1

An amorphous ribbon having a composition of $Fe_{73.5}Cu_1Nb_3Si_{13.5}B_9$ produced using a rapid solidification process (RSP), has been thermally treated for forty minutes at 540° C. under the nitrogen to thereby obtain a nano-scale grain ribbon. The crystallized grain size is 10 to 15 nm as shown in FIG. 2. After crushing the nano-scale grain ribbon by using a crusher, powder having passed through a sieve of −100~+140 meshes of 50%, and powder having passed through a sieve of −140~+200 meshes of 50% have been obtained through a classification and measurement of the powder particles.

Then, the produced nano-scale grain powder has been mixed with low melting point glass of 3 wt %, to then be dried. After having dried, a lump of the powder having been mixed with low melting point glass has been again crushed by using a ball mill, and then Zn-stearate of 0.5 wt % has been added to and mixed with the crushed powder. Thereafter, the powder having been mixed with the Zn-stearate has been formed with a forming pressure of 16 ton/cm$^2$ by using a core mold, to thereby produce a toroidal core.

Thereafter, the core formed body has undergone an annealing process for 30 minutes at a temperature of 450° C., and then epoxy resin has been coated on the surface of the core with a thickness of 100 μm, to then measure a high-frequency characteristic and a direct-current overlapping characteristic, which are illustrated in the following Table 1 and FIGS. 3 and 4.

A magnetic permeability according to a frequency is estimated as follows.

Enamel copper wire has been wound by thirty turns, and then inductance L (μH) of the thirty turns of the enamel copper wire has been measured from 1 kHz to 10 MHz by using a precise LCR meter. Then, a magnetic permeability (μ) has been obtained by a relationship of a toroidal core, that is, $L=(0.4\,n\mu N^2A\times10^{-2})/l$). Here, N denotes the number of turns, A denotes the sectional area of the core, and l denotes an average length of magnetic paths. Measuring conditions are an alternating-current (AC) voltage of 1V and the state where direct-current (DC) is not overlapped, that is, $I_{DC}=0$ A.

Also, a direct-current value is changed, change in a magnetic permeability is measured, and a direct-current (DC) overlapping characteristic is tested. Here, measuring conditions a frequency of 100 kHz, and an alternating-current (AC) voltage of 1V.

Also, in Table 1, "Sendust" of Magnetics Company and "High Flux" and "MPP" available in the market are used as the conventional materials 1 to 3 for comparison with the present invention material, respectively. In Table 1, a magnetic permeability at a frequency of 100 kHz and 10 MHz and a direct-current (DC) overlapping characteristic at 50 Oe have been compared between the present invention material and the conventional materials. The measured values of the conventional materials are given from those written in catalogs provided by each company.

TABLE 1

| | Magnetic permeability (100 kHz, 1 V) | High-frequency magnetic permeability (10 MHz, 1 V) | DC overlapping characteristic (%) (100 kHz)(60 Oe) |
|---|---|---|---|
| The present invention | 125 | 110 | 50 |
| Conventional 1 ("Sendust") | 125 | 102 | 33 |
| Conventional 2 ("High Flux") | 125 | 27.5 | 55 |
| Conventional 3 ("MPP") | 125 | 43.7 | 42 |

Figure 3:
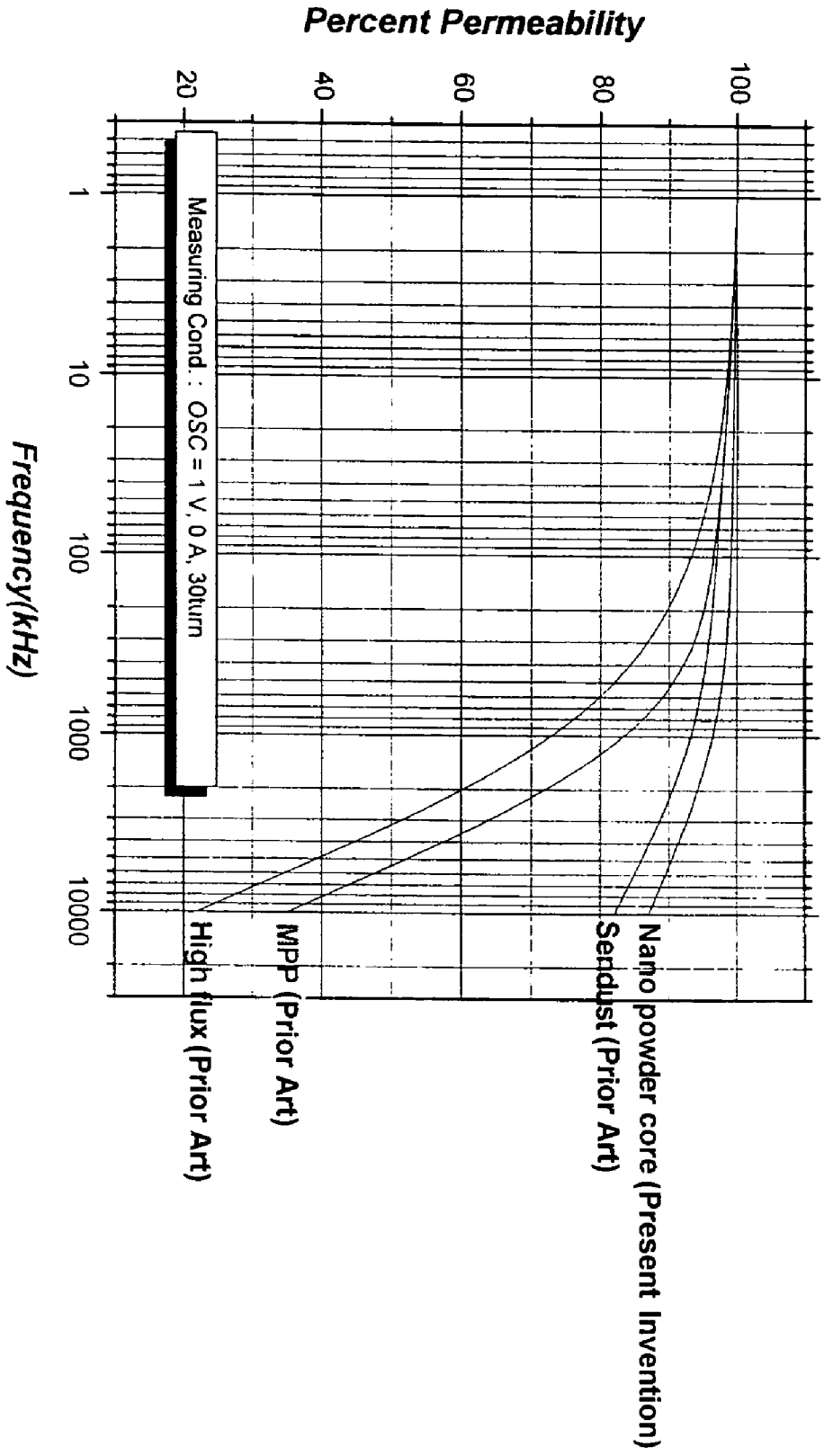
FIG. 3 is a graphical view illustrating a relationship between a frequency and a magnetic permeability of a high-frequency soft magnetic core according to the present invention.

As shown in FIG. 3, a high-frequency inductor core produced according to the present invention shows a magnetic permeability generally higher than those of "Sendust", "High Flux" and MPP produced by the conventional methods.

Figure 4:
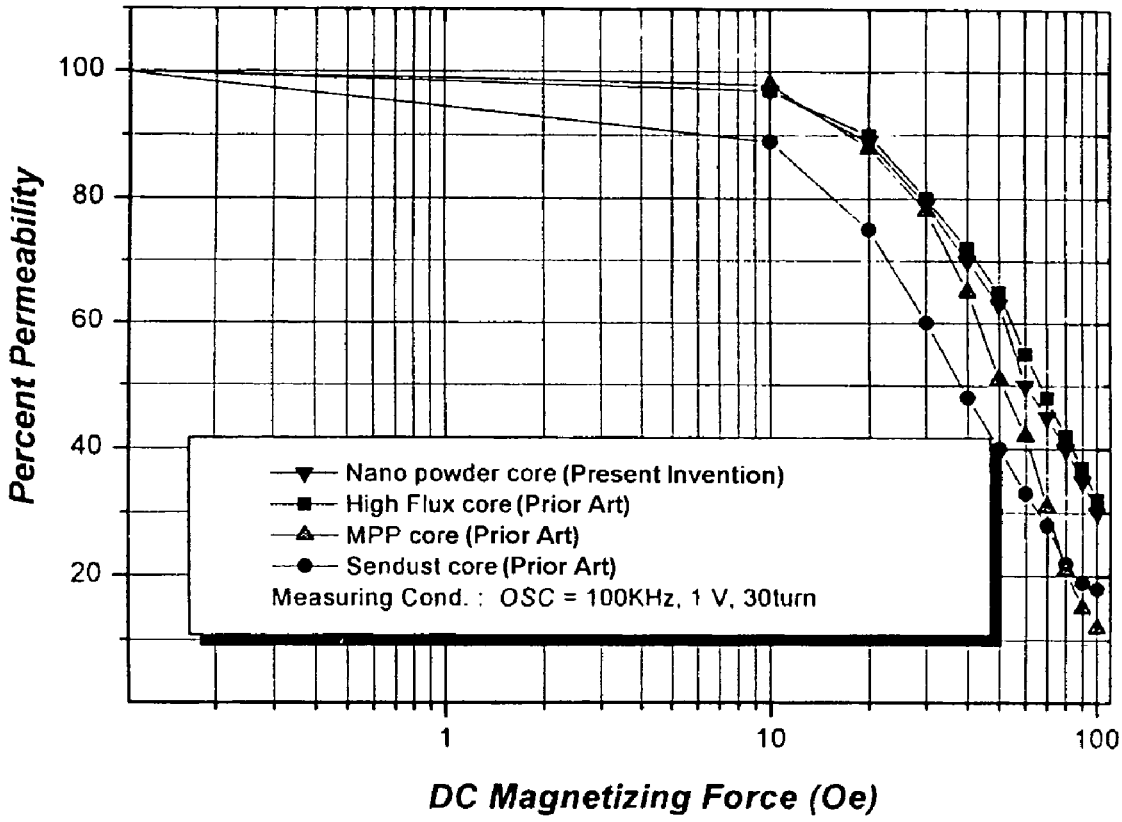
FIG. 4 is a graphical view illustrating a relationship between a direct-current (DC) overlapping characteristic and a magnetic permeability of a high-frequency soft magnetic core according to the present invention.

As shown in FIG. 4, a direct-current (DC) overlapping characteristic of an inductor core called a nano power core according to the present invention is lower than that of a "High Flux" core, but shows a generally high value.

From the above result, it can be seen that a soft magnetic core having an excellent high-frequency characteristic and a large direct-current (DC) overlapping characteristic can be produced by using nano-scale gram metal powder.

Embodiment 2

Figure 5:
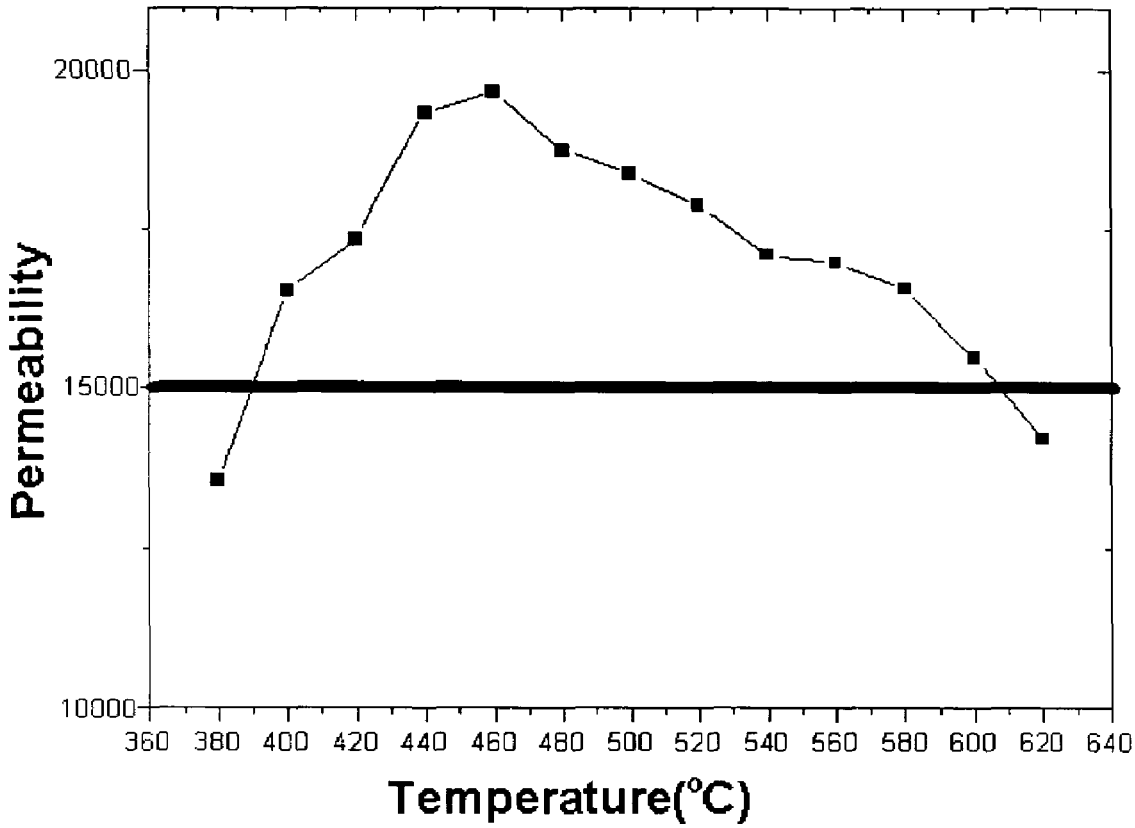
FIG. 5 is a graphical view illustrating change in a magnetic permeability according to change in a thermal treatment temperature during thermal treatment crystallizing an amorphous metal ribbon on a nano-scale basis.

In EMBODIMENT 2, a magnetic permeability of a ribbon and a size of crystallized grain which is obtained by nano-scale crystallizing and thermally treating the amorphous metal ribbon under the nitrogen at a temperature of 380 to 620° C. for 0.2 to 2 hours, have been measured. FIG. 5 illustrates change in a magnetic permeability according to change in a thermal treatment temperature, and Table 2 shows size of crystallized grain according to the thermal treatment temperature and the thermal treatment time.

In FIG. 5, a magnetic permeability has been compared according to the most proper time, which is a magnetic permeability at a ribbon state. Only when a ribbon-state magnetic permeability is 15000 or more, a feature of a magnetic permeability of 125 or more is embodied at 100 kHz and 1V after forming a core.

As can be seen from FIG. 5, a magnetic permeability of 15000 or more is embodied at a range between 400 to 600° C., and is not embodied at a temperature of 400° C. or lower or 600° C. or higher.

Table 2 illustrates comparison results of the crystallized grain at a temperature of 380, 420, 540, 600 and 620° C.

TABLE 2

| Thermal treatment temperature (° C.) | Thermal treatment time (hr) | Crystallized grain (nm) |
|---|---|---|
| 380 | 2 | 8~15 |
| 420 | 1.5 | 10~20 |
| 540 | 0.6 | 10~20 |
| 600 | 0.2 | 10~20 |
| 620 | 0.12 | 15~25 |

As illustrated in Table 2, when the thermal treatment temperature is 440, 540, and 580° C., a size of the crystallized grain of 10~20 nm is obtained. If a ribbon is thermally treated at 380° C. for 2 hours, a size of the crystallized grain of 8~15 nm is obtained, which also shows a remarkably low crystallized grain ratio. If a ribbon is thermally treated at 620° C. for 0.12 hours, a size of the crystallized grain of 15~25 nm is obtained.

Thus, in order to make the size of the crystallized grain having an excellent magnetic permeability have a range between 10 and 20 nm, it is preferable that the thermal treatment temperature ranges from 400 to 600° C.

Embodiment 3

An amorphous ribbon has been produced in the same manner as that of EMBODIMENT 1. Powder having passed through a sieve of −100~+140 meshes of 70%, and powder having passed through a sieve of −140~+200 meshes of 30% have been used as powder particles of the nano-scale metal powder. When a core has been formed through an extruding former, cracks have occurred on the surface of the core, after having formed the core. Thus, the core has been broken after having treated the core thermally.

If powder having passed through a sieve of −100~+140 meshes of 65% or more is used, it can be seen, from the experiments changing a distribution of powder particles of the metal powder, that cracks occur during forming and a core of a desired characteristic cannot be obtained.

Embodiment 4

An amorphous ribbon has been produced in the same manner as that of EMBODIMENT 1. Powders having passed through a sieve of −100~+140 meshes of 10%, and powders having passed through a sieve of −140~+200 meshes of 90% have been used as powder particles of the amorphous metal powders. When a magnetic feature is estimated after coating, a magnetic permeability was 105 at 100 kHz, which was lower by 16% than that of the core of EMBODIMENT 1 using powders having passed through a sieve of −100~+140 meshes of 50%, and powders having passed through a sieve of −140~+200 meshes of 50%.

If powders having passed through a sieve of −100~+140 meshes of 15% or less are used, it can be seen, from the experiments changing a distribution of powder particles of the metal powders, that a magnetic permeability of 125 or more cannot be obtained.

Embodiment 5

An amorphous ribbon has been produced in the same manner as that of EMBODIMENT 1. Contents of low melting point glass used as a binder have been used as 1.3%, 1.5%, 4.5% and 5.5% in unit of weight %, respectively.

In the case of a core having produced by adding the low melting point glass of 1.3 wt % therein, a high-frequency magnetic permeability at 10 MHz and 1V has been 100 or so. Meanwhile, in the case of a core having produced by adding the low melting point glass of 5.5 wt % therein, a high-frequency magnetic permeability at 10 MHz and 1V has been 95 or so. This is a phenomenon that occurs when a density of nano-scale grain metal powders is reduced due to an excessive addition of the low melting point glass.

Also, in the case of a core having produced by adding a binder of a range from 1.5 wt % to 4 wt %, no big problems have happened.

Embodiment 6

An amorphous ribbon has been produced in the same manner as that of EMBODIMENT 1. At the time of performing an annealing process, the thermal treatment temperatures have been changed into 290, 300, 400, 500 and 510° C., and the thermal treatment time has been changed from ten minutes to eight hours. Table 3 shows a change in a thermal treatment time having the highest magnetic permeability at the same temperature, and a magnetic permeability according to the highest thermal treatment time.

TABLE 3

| Thermal treatment temperature (° C.) | Thermal treatment time (hr) | Magnetic permeability (100 kHz, 1 V) |
|---|---|---|
| 290 | 4 | 96 |
| 300 | 3.8 | 106 |
| 400 | 0.7 | 110 |
| 500 | 0.2 | 108 |
| 510 | 0.13 | 98 |

As can be seen from Table 3, a magnetic permeability of 105 or more can be realized at 300, 400 and 500° C. However, a magnetic permeability of 105 or more cannot be realized at 290 and 510° C. That is, it is preferable that an annealing process should be performed at a temperature of 300° C. or more and 500° C. or less.

As described above, a soft magnetic core according to the present invention is produced by using Fe-based amorphous metal ribbon containing an expensive element, to thereby provide a cost competitive force and an excellent high-frequency characteristic of 1 MHz differently from the conventional cores since the soft magnetic core includes a nano-scale grain. This is because the Fe-based nano-scale grain alloy has a high saturation magnetic flux density, a high magnetic permeability, a low coercive force, and an excellent thermal stability, to thereby make a core product compact and light.

Also, the nano-scale grain metal powders obtained by crushing a solidified ribbon by a rapid solidification process (RSP) in the present invention, have a higher composition uniformity and a lower oxidation level than those of the powders produced by the conventional fluid spraying method, which means that the nano-scale grain metal powders can be used for a product requiring for a high quality and a high reliability. Further, a nano-scale grain soft magnetic core having the excellent high-frequency characteristic can be employed widely in the field of a switching mode power supply (SMPS), DC converters, and noise filters requiring for a high-frequency characteristic, compactness, lightness, high quality and high reliability.

As described above, the present invention has been described with respect to particularly preferred embodiments. However, the present invention is not limited to the above embodiments, and it is possible for one who has an ordinary skill in the art to make various modifications and variations, without departing off the spirit of the present invention.

What is claimed is:

1. A method of making a soft magnetic core having an excellent high-frequency characteristic comprising the steps of:

performing a thermal treatment of Fe-based amorphous metal ribbons produced by using a rapid solidification process (RSP) to then be converted into nano-scale grain metal ribbons;

crushing the nano-scale grain metal ribbons to thereby obtain nano-scale grain metal powders;

classifying the nano-scale grain metal powders to then be mixed into a distribution of powder particles made of first powders that have passed through a sieve of −100~+140 meshes of 15~65%, and second powders that have passed through a sieve of −140~+200 meshes of 35~85%;

mixing the mixed nano-scale grain metal powders with a binder, and then forming a core; and annealing the formed core and then coating the core with an insulating resin.

2. The method of making a soft magnetic core of claim 1, wherein the nano-scale crystallization thermal treatment is performed at 400~600° C., for 0.2~2 hours under a nitrogen atmosphere.

3. The method of making a soft magnetic core of claim 1, wherein the binder includes low melting point glass ranging from 1.5 to 5 wt %.

4. The method of making a soft magnetic core of claim 1, wherein the annealing process is performed for 0.2 to 3.8 hours at a temperature of 300 to 500° C.

5. A method of making nano-scale grain metal powders for use in a soft magnetic core having an excellent high-frequency characteristic comprising the steps of:

performing a thermal treatment of Fe-based amorphous metal ribbons produced by using a rapid solidification process (RSP) to then be converted into nano-scale grain metal ribbons;

crushing the nano-scale grain metal ribbons to thereby obtain nano-scale grain metal powders; and classifying the nano-scale grain metal powders to then be mixed into a distribution of powder particles made of first powders having passed through a sieve of −100~+140 meshes of 15~65%, and second powders having passed through a sieve of −140~+200 meshes of 35~85%.

6. The method of making nano-scale grain metal powders of claim 5, wherein the Fe-based amorphous metal ribbon which is used to obtain the nano-scale grain metal powder is made of an amorphous metal alloy comprising Fe as a basic composition, at least one element selected from the group consisting of P, C, B, Si, Al and Ge, and at least one selected from the group consisting of Nb, Cu, Hf, Zr, and Ti.

7. The method of making nano-scale grain metal powders of claim 6, wherein the nano-scale crystallization thermal treatment of the amorphous metal ribbon is performed at 400~600° C., for 0.2~2 hours under a nitrogen atmosphere.

* * * * *